US006616499B1

(12) United States Patent
Sorensen

(10) Patent No.: US 6,616,499 B1
(45) Date of Patent: Sep. 9, 2003

(54) INTERCONNECTION OF TOY BUILDING ELEMENTS IN A RELEASABLE SECURE ENGAGEMENT

(76) Inventor: Soren Christian Sorensen, P.O. Box 256 North Side, Grand Cayman (KY)

( * ) Notice: Subject to any disclaimer, the term of this patent is extended or adjusted under 35 U.S.C. 154(b) by 0 days.

(21) Appl. No.: 09/889,621

(22) PCT Filed: Feb. 1, 2000

(86) PCT No.: PCT/EP00/00760

§ 371 (c)(1),
(2), (4) Date: Jul. 17, 2001

(87) PCT Pub. No.: WO00/47302

PCT Pub. Date: Aug. 17, 2000

Related U.S. Application Data

(63) Continuation-in-part of application No. 09/246,317, filed on Feb. 8, 1999, now Pat. No. 6,250,986.

(51) Int. Cl.[7] ..... A63H 33/04; A63H 33/06

(52) U.S. Cl. ..... 446/85; 446/121; 446/127

(58) Field of Search ..... 446/85, 87, 120, 446/121, 124, 125, 127, 128

(56) References Cited

U.S. PATENT DOCUMENTS

| | | | | |
|---|---|---|---|---|
| 3,413,752 A | | 12/1968 | Perry | |
| 3,479,763 A | | 11/1969 | Fischer | |
| 3,745,736 A | | 7/1973 | Fischer et al. | |
| 4,160,337 A | | 7/1979 | Fischer | |
| 5,069,647 A | | 12/1991 | Zuviria | |
| 5,350,331 A | | 9/1994 | Glickman | |
| 5,527,201 A | | 6/1996 | Maddock | |
| 5,645,464 A | * | 7/1997 | Chen | 446/120 |
| 5,653,621 A | | 8/1997 | Yao | |
| 5,853,314 A | | 12/1998 | Bora | |
| 5,951,356 A | * | 9/1999 | Cyrus et al. | 446/118 |
| 6,250,986 B1 | | 6/2001 | Sorensen | |
| 6,447,360 B1 | * | 9/2002 | Sorensen | 446/124 |

FOREIGN PATENT DOCUMENTS

| | | |
|---|---|---|
| DE | 21 05 568 A | 8/1972 |
| WO | WO 93/04749 | 3/1993 |

* cited by examiner

*Primary Examiner*—Jacob K. Ackun
(74) *Attorney, Agent, or Firm*—Edward W. Callan

(57) ABSTRACT

Square and octagonal building elements for a set of toy building elements that are capable of being inteconnected in a releasable engagement both side-to-side and top-to-bottom. The side walls of the building elements include a groove and/or a split flexible tongue that is compressed when frontally forced into a groove in another such building element to effect a releasable restraining frictional engagement within the groove. The degree of frictional engagement provided by compression of the tongue when a distal portion of the tongue resides in a base region of the groove is such as to enable a stationary relative disposition of a pair of so engaged building elements to be varied precisely by smoothly sliding the tongue of one of the pair of engaged building elements within the groove of the other of the pair of engaged building elements, and also is such as to provide enough resistance to sliding as to maintain the stationary relative disposition when one of the pair of engaged building elements has the top of its engaged side wall disposed at a greater height than the top of the engaged side wall of the other of the pair of building elements. The tongues and the grooves are also dimensioned so that less force is required to effect engagement by frontally pressing the building elements together than is required to effect disengagement by frontally pulling the building elements apart.

21 Claims, 7 Drawing Sheets

FIG. 7
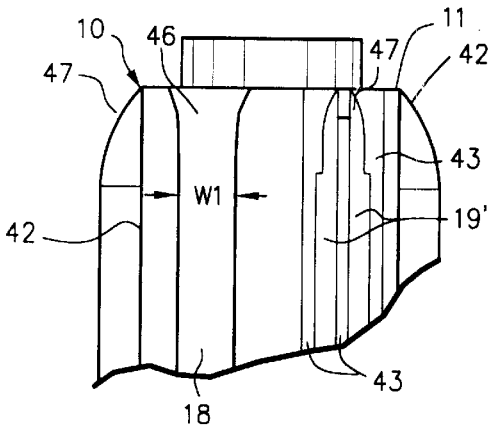
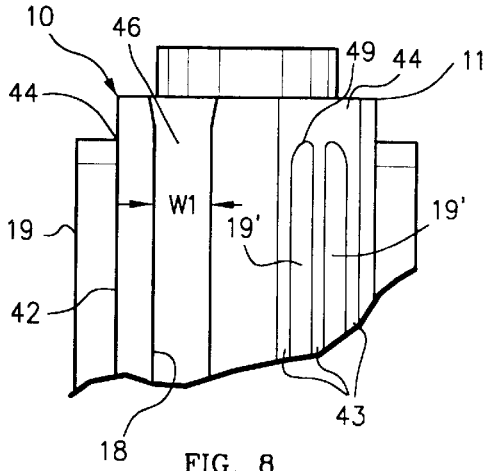
FIG. 8
FIG. 9
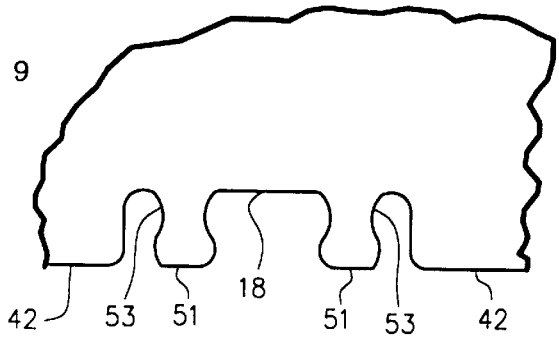
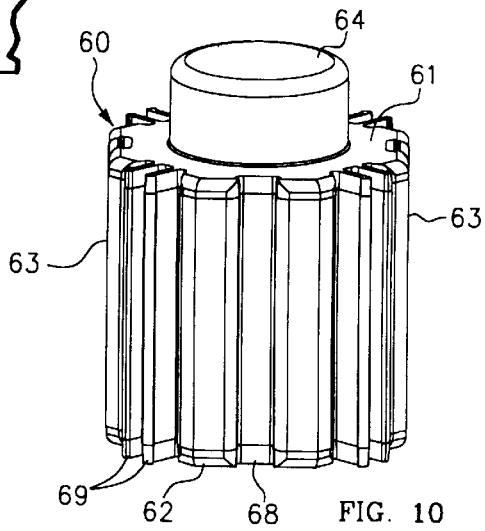
FIG. 10
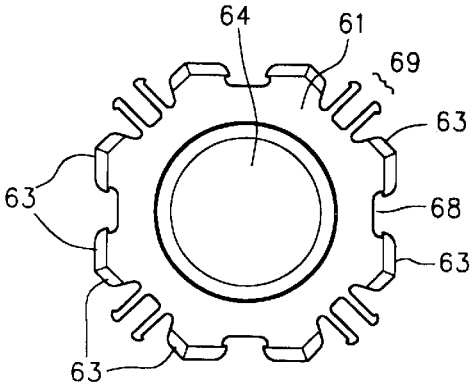
FIG. 11
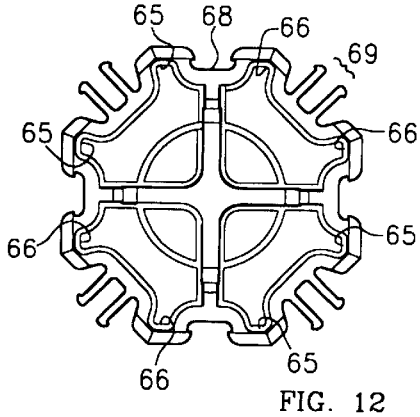
FIG. 12

FIG. 24
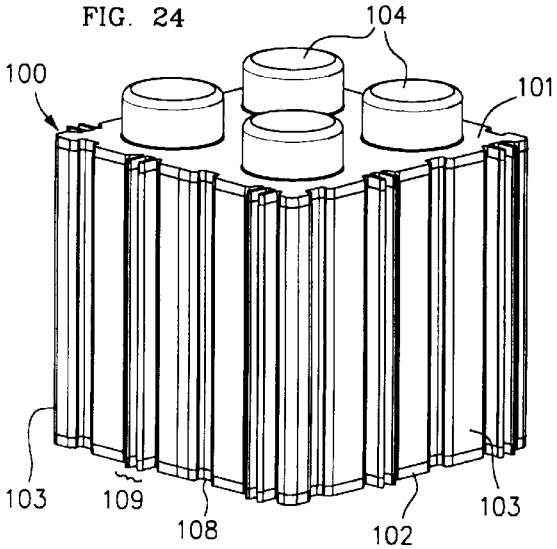
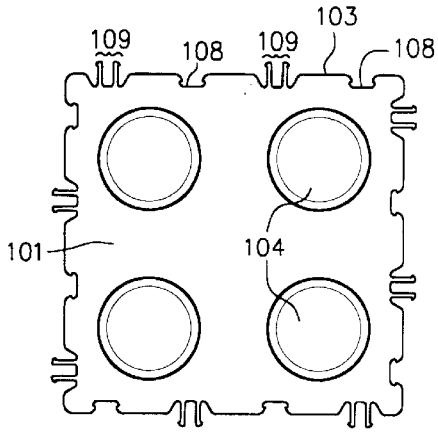
FIG. 25
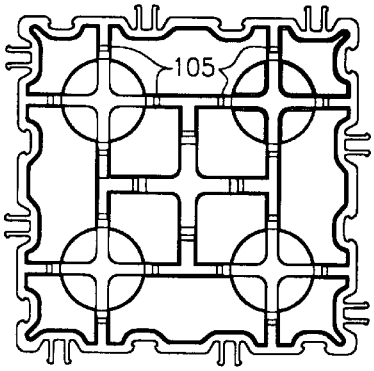
FIG. 26
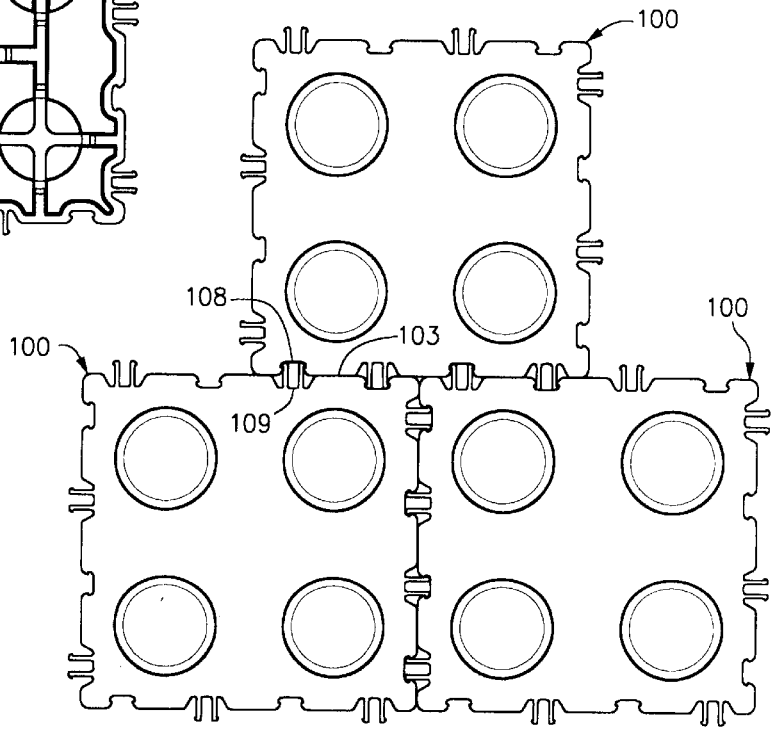
FIG. 27

INTERCONNECTION OF TOY BUILDING ELEMENTS IN A RELEASABLE SECURE ENGAGEMENT

REFERENCE TO RELATED APPLICATION

This application is a continuation-in-part of my application Ser. No. 09/246,317 filed Feb. 8, 1999, now U.S. Pat. No. 6,250,986, issued Jun. 26, 2001.

BACKGROUND OF THE INVENTION

The present invention generally pertains to assembly toys and is particularly directed to an improved building element for a set of toy building elements.

Examples of prior art toy building elements are described in European Patent No. 0,766,585 in U.S. Pat. Nos. 2,132,757; 3,195,266; 3,374,917; 3,745,736; 5,527,201; 5,653,621; 5,795,210 and 5,826,395 in International Application Publication No. WO 98/35735 and in Deutsches Offenlegungsschrift 2,105,568.

WO 98/35735 describes a building element for a set of toy building elements that are capable of being interconnected in a releasable engagement, comprising a top, a bottom and side walls; wherein a first pair of oppositely disposed side walls each includes a receptacle having an entry opening of a given predominant width and a base region of a greater width; wherein another pair of oppositely disposed side walls each includes a peg having an indented portion and a distal portion, with the distal portion having a predominant width that is greater than the width of the indented portion and greater than the given predominant width of the receptacle entry opening for interconnecting in a releasable restraining engagement with a said receptacle in a side wall of another said building element with the distal portion of the peg residing in the base region of the receptacle.

U.S. Pat. No. 5,527,201 describes a toy building element having tongues and grooves formed on the side walls of the building element; wherein the grooves each have an entry opening of a given predominant width and a base region of a greater width; wherein the tongues each have an indented portion and a distal portion, with the distal portion having a predominant width that is greater than the width of the indented portion and greater than the given predominant width of the groove entry opening for interconnecting in a releasable restraining engagement with a said groove in a side wall of another said building element with the distal portion of the tongue residing in the base region of the groove; and wherein each tongue is flexible and split longitudinally into two parallel sections so that the tongue can be compressed laterally in order to effect said restraining engagement by frontally pressing the tongue into a said groove in another said building element.

SUMMARY OF THE INVENTION

In one aspect, the present invention provides a building element for a set of toy building elements that are capable of being interconnected in a releasable engagement, comprising a top, a bottom and side walls; wherein at least one of the side walls includes at least one groove having an entry opening of a given predominant width and a base region of a greater width; wherein at least one of the side walls includes at least one tongue having an indented portion and a distal portion, with the distal portion having a predominant width that is greater than the width of the indented portion and greater than the given predominant width of the groove entry opening for interconnecting in a releasable restraining engagement with a said groove in a side wall of another said building element with the distal portion of the tongue residing in the base region of the groove; and wherein the tongue is flexible and split longitudinally into two parallel sections, each of which includes part of the indented portion and part of the distal portion of the tongue so that the distal portion of the tongue can be compressed laterally in order to effect said restraining engagement by frontally pressing the tongue into a said groove in another said building element; wherein the uncompressed width of one of said portions of the tongue is greater than the predominant width of the portion of the groove that is adjacent said one portion of the tongue when the distal portion of the tongue resides in the base region of the groove so that said one portion of the tongue is then compressed between and thereby frictionally engages the portions of the side wall that define said adjacent portion of the groove.

Preferably, the degree of said frictional engagement provided by said compression of the tongue when the distal portion of the tongue resides in the base region of the groove is such as to enable a stationary relative disposition of a pair of so engaged building elements to be varied precisely by smoothly sliding the tongue of one of the pair of engaged building elements within the groove of the other of the pair of engaged building elements, and also is such as to provide enough resistance to said sliding as to maintain said stationary relative disposition when one of said pair of engaged building elements has the top of its engaged side wall disposed at a greater height than the top of the engaged side wall of the other of said pair of building elements.

In another aspect, the present invention provides a building element for a set of toy building elements that are capable of being interconnected in a releasable engagement, comprising a top, a bottom and side walls; wherein at least one of the side walls includes at least one groove having an entry opening of a given predominant width and a base region of a greater width; wherein at least one of the side walls includes at least one tongue having an indented portion and a distal portion, with the distal portion having a predominant width that is greater than the width of the indented portion and greater than the given predominant width of the groove entry opening for interconnecting in a releasable restraining engagement with a said groove in a side wall of another said building element with the distal portion of the tongue residing in the base region of the groove; wherein the tongue is flexible and split longitudinally into two parallel sections, each of which includes part of the indented portion and part of the distal portion of the tongue so that the distal portion of the tongue can be compressed laterally in order to effect said restraining engagement by frontally pressing the tongue into the said groove in the other said building element and in order to disengage the tongue from the said groove in the other said building element by frontally pulling the building element from the other said building element; and wherein adjacent the entry opening the groove is defined by a first portion of the at least one side wall that is inclined outward at an entry angle and a second portion of the at least one side wall that is inclined inward at a restraining angle that is less than the entry angle in relation to a virtual broad surface of the at least one side wall.

In a further aspect, the present invention provides a building element for a set of toy building elements that are capable of being interconnected in a releasable engagement, comprising a top, a bottom and side walls; wherein at least one of the side walls includes at least one groove having an entry opening of a given predominant width and a base region of a greater width; wherein at least one of the side walls includes at least one tongue having an indented portion and a distal portion, with the distal portion having a predominant width that is greater than the width of the indented portion and greater than the given predominant width of the groove entry opening for interconnecting in a releasable restraining engagement with a said groove in a side wall of another said building element with the distal portion of the tongue residing in the base region of the groove; wherein the tongue is flexible and split longitudinally into two parallel sections, each of which includes part of the indented portion and part of the distal portion of the tongue so that the distal portion of the tongue can be compressed laterally in order to effect said restraining engagement by frontally pressing the tongue into the said groove in the other said building element and in order to disengage the tongue from the said groove in the other said building element by frontally pulling the building element from the other said building element; wherein adjacent the entry opening the groove is defined by a portion of the at least one side wall that is inclined inward at a restraining angle to define the base region of the groove; and wherein a portion of the tongue that initially contacts the portion of the at least one side wall at the entry opening, when the tongue is being frontally pressed into the said groove in the other said building element, is inclined outward at approximately a first angle; and wherein a portion of the tongue that is adjacent the inwardly inclined portion of the at least one side wall, when the distal portion of the tongue is engaged within the base region of the said groove in the other said building element, is inclined inward at a second angle than is less than the first angle in relation to a virtual broad surface of the at least one side wall.

In yet another aspect, the present invention provides a building element for a set of toy building elements that are capable of being interconnected in a releasable engagement, comprising a top, a bottom and side walls; wherein at least one of the side walls includes at least one groove having an entry opening of a given predominant width; wherein at least one of the side walls includes at least one tongue having a distal portion, with the distal portion having a predominant width that is greater than the given predominant width of the groove entry opening for interconnecting in a releasable restraining engagement with a said groove in another said building element; and wherein a said side wall including the at least one tongue has a primary surface that includes recesses adjacent the tongue so that the tongue extends outward from below the primary surface.

In yet a further aspect, the present invention provides a building element for a set of toy building elements that are capable of being interconnected in a releasable engagement, comprising a top, a bottom and side walls, wherein the top includes a first type of coupling means and the bottom includes a second type of coupling means for interconnecting with the first type of coupling means on another said building element in a releasable frictional engagement; wherein at least one of the side walls includes at least one groove having an entry opening of a given predominant width; wherein at least one of the side walls includes at least one tongue having a distal portion, with the distal portion having a predominant width that is greater than the given predominant width of the groove entry opening for interconnecting in a releasable restraining engagement with a said groove in another said building element; wherein the tongue is flexible and split longitudinally so that the tongue can be compressed laterally in order to effect said restraining engagement by frontally pressing the tongue into a said groove in another said building element; and wherein at least one of an adjacent pair of side walls are disposed at an oblique angle to one another, with each of said obliquely disposed adjacent pair including at least one said groove and at least one said tongue.

In an additional aspect, the present invention provides a building element for a set of toy building elements that are capable of being interconnected in a releasable engagement, comprising a top, a bottom and side walls, wherein the top includes a first type of coupling means and the bottom includes a second type of coupling means for interconnecting with the first type of coupling means on another said building element in a releasable frictional engagement; wherein at least one of the side walls includes at least one groove having an entry opening of a given predominant width; wherein at least one of the side walls includes at least one tongue having a distal portion, with the distal portion having a predominant width that is greater than the given predominant width of the groove entry opening for interconnecting in a releasable restraining engagement with a said groove in another said building element; wherein the tongue is flexible and split longitudinally so that the tongue can be compressed laterally in order to effect said restraining engagement by frontally pressing the tongue into a said groove in another said building element; and wherein each of a plurality of the side walls includes a plurality of said grooves and a plurality of said tongues.

In a further additional aspect, the present invention provides a building element for a set of toy building elements that are capable of being interconnected in a releasable engagement, comprising a top, a bottom and side walls; wherein at least one of the side walls includes at least one groove having an entry opening of a given predominant width and a base region of a greater width; wherein at least one of the side walls includes at least one tongue having a distal portion, with the distal portion having a predominant width that is greater than the given predominant width of the groove entry opening for interconnecting in a releasable restraining engagement with a said groove in another said building element; wherein the at least one tongue and/or the entry opening of the at least one groove is flexible so that said restraining engagement can be effected by frontally pressing the tongue into a said groove in another said building element; and wherein one of an adjacent pair of the side walls includes at least one said groove and the other of the adjacent pair includes at least one said tongue, and the adjacent pair are disposed at an oblique angle to one another; characterized in that (a) each of said obliquely disposed adjacent pair of side walls includes at least one said groove and at least one said tongue; or (b) the side walls define an octagon, each of a first set of every-second side wall includes a said groove but no tongue, and each of a second set of every-second side walls disposed between the side walls of the first set includes a said tongue but no groove; or (c) the side walls define an octagon, and each side wall includes at least one said groove and at least one said tongue; or (d) the side walls define a four-sided parallelogram having four oblique angles, with at least one of the side walls including at least one said groove and with at least one of the side walls including at least one said tongue.

In still another aspect, the present invention provides a set of toy building elements that are capable of being interconnected side-by-side in a releasable restraining engagement, comprising a first building element as specified in the preceding paragraph; and a second building element, comprising a top, a bottom and side walls defining a rectangle; wherein at least one of the side walls of the second building element includes at least one groove having an entry opening of the given predominant width and a base region of a greater width; wherein at least one of the side walls of the second building element includes at least one tongue having a distal portion, with the distal portion having a predominant width that is greater than the given predominant width of the groove entry opening of the first and second building elements for interconnecting in a releasable restraining engagement with a said groove in either the first building element or another said second building element; and wherein one of an adjacent pair of the side walls of the second building element includes at least one said groove and the other of the adjacent pair includes at least one said tongue.

In a still further aspect, the present invention provides a set of toy building elements that are capable of being interconnected side-by-side in a releasable restraining engagement, wherein a first building element and a second building element each comprises a top, a bottom and side walls; wherein at least one of the side walls includes at least one groove having an entry opening of a given predominant width and a base region of a greater width; wherein at least one of the side walls includes at least one tongue having a distal portion, with the distal portion having a predominant width that is greater than the given predominant width of the groove entry opening for interconnecting in a releasable restraining engagement with a said groove in another said building element; wherein the at least one tongue and/or the entry opening of the at least one groove is flexible so that said restraining engagement can be effected by frontally pressing the tongue into a said groove in another said building element; wherein one of an adjacent pair of the side walls includes at least one said groove and the other of the adjacent pair includes at least one said tongue, and the adjacent pair are disposed at an oblique angle to one another; wherein in the first building element a said one adjacent pair of side walls are disposed at a first oblique angle to one another; and wherein in the second building element a said one adjacent pair of side walls are disposed at a second oblique angle to one another, with the second oblique angle being different than the first oblique angle.

Additional features of the present invention are described with reference to the detailed description of the preferred embodiments.

BRIEF DESCRIPTION OF THE DRAWING

FIG. 7 is a partial side view of the building element of FIG. 1 that is enlarged and exaggerated in part to better illustrate the relative predominant widths of the tongue and the groove entry opening and the relative widths of the tongue and the groove entry opening near the top of a side wall.

FIG. 8 is a partial side view of an alternative embodiment to the building element of FIG. 1 that is enlarged and exaggerated in part to better illustrate the relative predominant widths of the tongue and the groove entry opening and the relative widths of the tongue and the groove entry opening near the top of a side wall.

FIG. 9 is an enlarged partial top view of an alternative embodiment to the building element of FIG. 1 illustrating a groove that is defined by flexible partially depressed side walls.

FIG. 10 is a top and two-sided perspective view of another preferred embodiment of a building element according to the present invention, wherein the side walls define an octagon.

FIG. 11 is a top view of the building element of FIG. 10.

FIG. 12 is a bottom view of the building element of FIG. 10.

FIG. 24 is a top and two-sided perspective view of another preferred embodiment of a building element according to the present invention.

FIG. 25 is a top view of the building element of FIG. 24.

FIG. 26 is a bottom view of the building element of FIG. 24.

FIG. 27 is a top view illustrating the interconnection of one side wall of one building element according to FIG. 24 with side walls of two other building elements according to FIG. 24.

DETAILED DESCRIPTION

Figure 1:
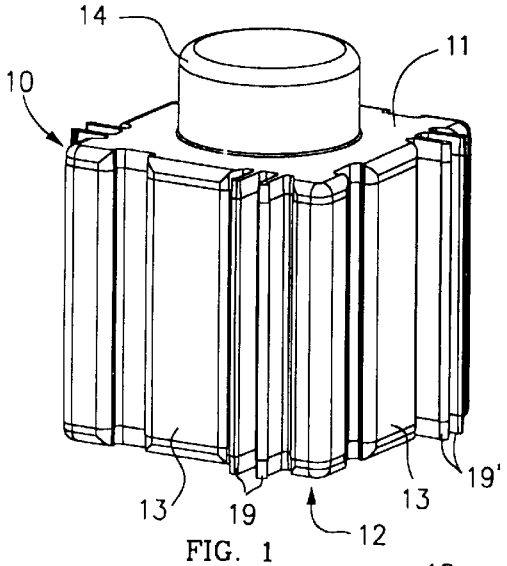
FIG. 1 is a top and two-sided perspective view of a preferred embodiment of a building element according to the present invention.
Figure 2:
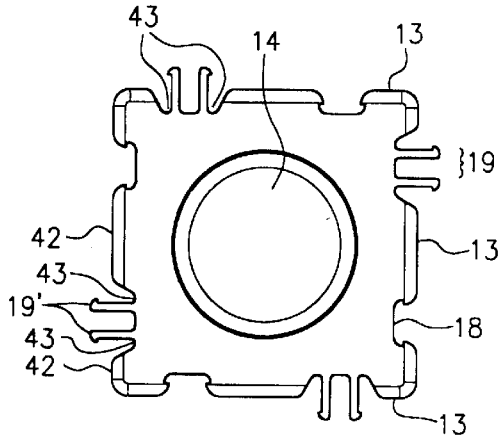
FIG. 2 is a top view of the building element of FIG. 1.
Figure 3:
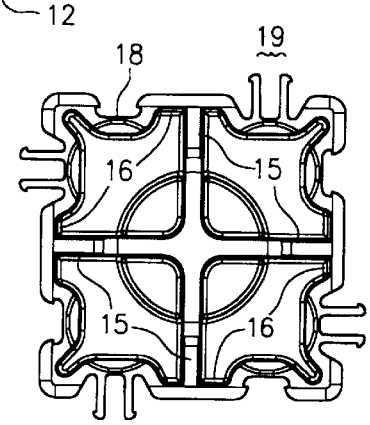
FIG. 3 is a bottom view of the building element of FIG. 1.

Referring to FIGS. 1 through 3, a preferred embodiment of a building element 10 according to the present invention includes a top 11, a bottom 12 and four side walls 13. The top 11 of the building element 10 includes a cylindrical projection 14 and the bottom 12 of the building element 10 is open. The four side walls 13 define a square.

The interior surfaces of the building element 10 include ribs 15 that are accessible through the open bottom 12 of the building element 10. The ribs 15 extend inwardly at a right angle from the center of each interior side wall 16 for interconnecting with the projection 14 on the top of another such building element 10 in a releasable frictional engagement.

Figure 4:
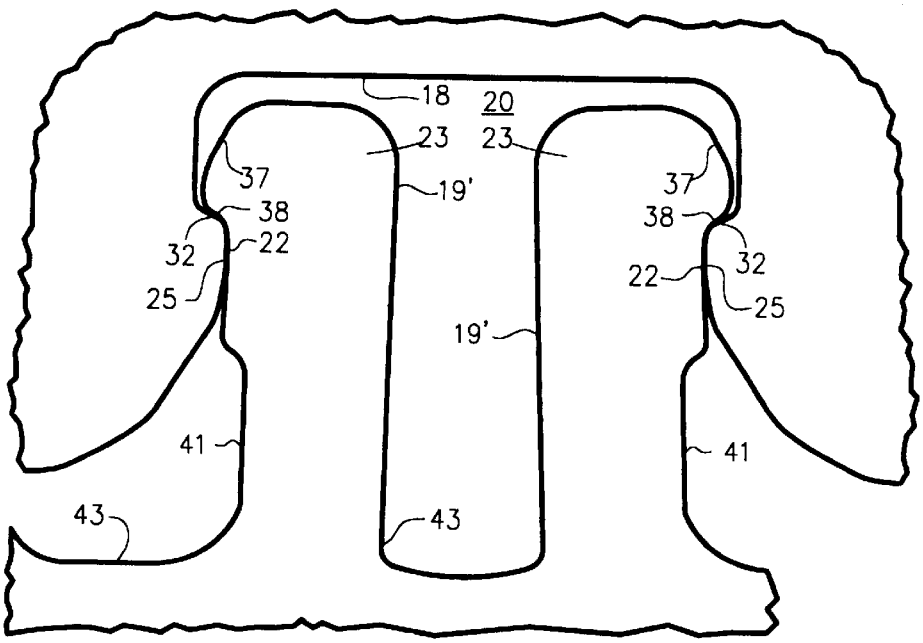
FIG. 4 is an enlarged partial top view illustrating the frictional engagement between the tongue and the portion of the side wall that include the groove in accordance with one preferred embodiment of the building element according to FIG. 1 when the distal portion of a tongue of one such building element resides in the base region of a groove of another such building element.
Figure 5:
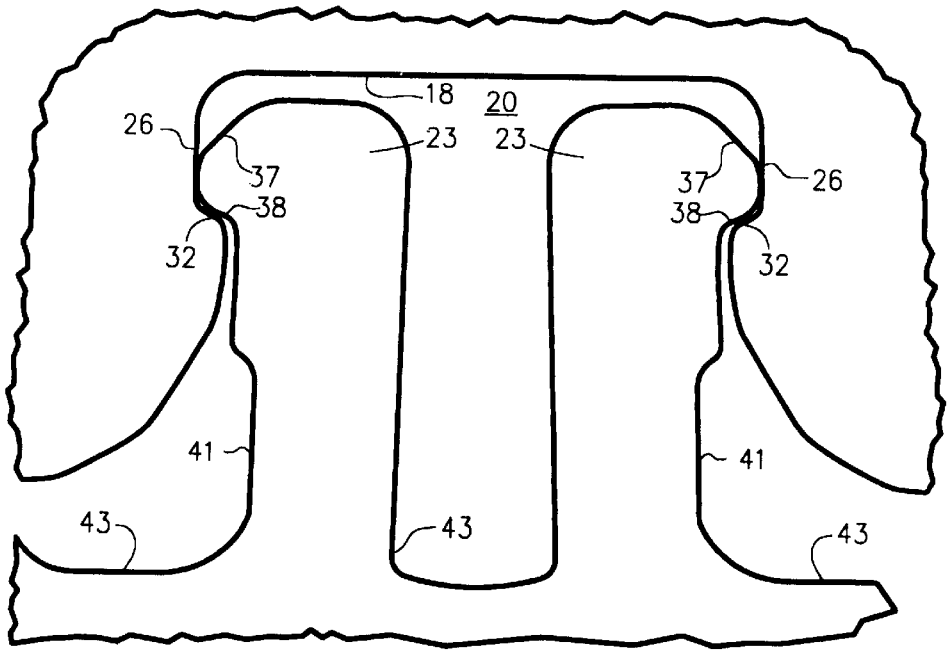
FIG. 5 is an enlarged partial top view illustrating the frictional engagement between the tongue and the portions of the side wall that include the groove in accordance with another preferred embodiment of the building element according to FIG. 1 when the distal portion of a tongue of one such building element resides in the base region of a groove of another such building element.
Figure 6:
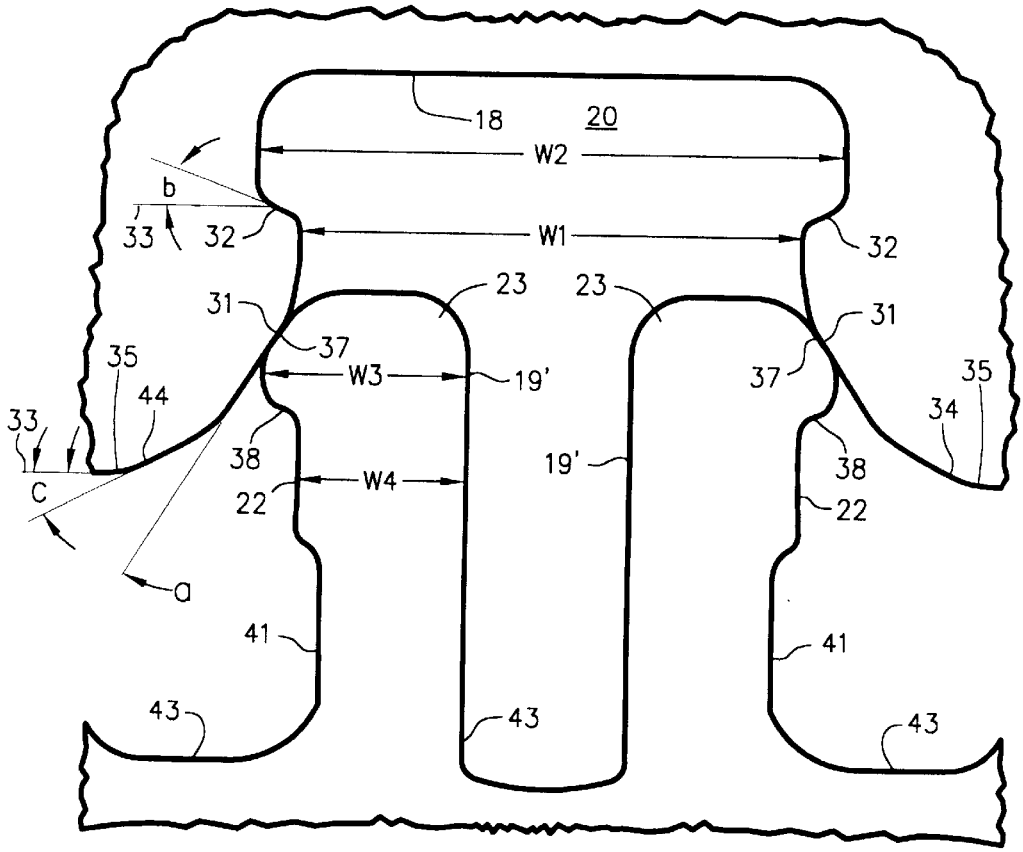
FIG. 6 is an enlarged partial top view illustrating the initial stage of an interconnection between two building elements according to FIG. 1 when one side of a tongue initially contacts one side of a groove, and further illustrating the lateral contour of the one side of the tongue and the one side of the groove.

Each of the side walls 13 includes one groove 18 and one tongue 19 that are dimensioned for enabling a tongue 19 on one building element 10 to reside in a groove 18 in another such building element 10 in a releasable restraining engagement, as shown in FIG. 4 or 5. Referring to FIG. 6, each groove 18 has an entry opening of a given predominant width W1 and a base region 20 of a greater width W2. The predominant width W1 of the entry opening 20 is the minimum width W1 of the groove 18 that predominates over the length of the groove 18 between the top 11 and the bottom 12 of the building element 10.

Still referring to FIG. 6, each tongue has an indented intermediate portion 22 and a distal portion 23. The distal portion 23 has a predominant width W3 that is greater than the width W4 of the intermediate indented portion 22 and greater than the given predominant width W1 of the groove entry opening for interconnecting in a releasable restraining engagement with a groove 18 in a side wall 13 of another such building element 10 so that the distal portion 23 of the tongue resides in the base region 20 of the groove 18, as shown in FIG. 4 or 5. The predominant width W3 of the distal portion 23 is the maximum width W3 of the distal portion 23 that predominates over the length of the tongue 19 between the top 11 and the bottom 12 of the building element 10.

The tongue 19 is flexible and split longitudinally into two parallel sections 19'. Each of the parallel sections 19' of the tongue includes part of the indented intermediate portion 22 and part of the distal portion 23 of the tongue 19 so that the distal portion 23 of the tongue 19 can be compressed laterally in order to effect the restraining engagement in the groove 18 by frontally pressing the tongue 19 into the groove 18 in another building element 10.

The relative dimensions of the groove 18 and the tongue 19 are such that when the distal portion of the tongue resides in the base region of the groove, part of the tongue is compressed between and thereby frictionally engages some portions of the side wall 13 that are adjacent the groove 18. The degree of the frictional engagement provided by the compression of the tongue 19 when the distal portion 23 of the tongue 19 resides in the base region 20 of the groove 18 is such as to enable a stationary relative disposition of a pair of so engaged building elements 10 to be varied precisely by smoothly sliding the tongue 19 of one of the pair of engaged building elements 10 within the groove 18 of the other of the pair of engaged building elements 10, and also is such as to provide enough resistance to such sliding as to maintain the stationary relative disposition when one of the pair of engaged building elements has the top of its engaged side wall 13 disposed at a greater height than the top of the engaged side wall 13 of the other of the pair of building elements 10.

In one preferred embodiment, as shown in FIG. 4, the uncompressed width W4 of the indented intermediate portion 22 of the tongue 19 (as shown in FIG. 6) is greater than the predominant width W1 of the groove entry opening so that, when the distal portion 23 of the tongue resides in the base region 20 of the groove, the indented intermediate portions 22 of the two parallel sections 19' of the tongue are compressed between and thereby frictionally engage portions 25 of the side wall that are adjacent the groove entry opening.

In another preferred embodiment, as shown in FIG. 5, the uncompressed width W3 of the distal portion 23 of the tongue 19 (as shown in FIG. 6) is greater than the width W2 of the base region 20 of the groove 18 so that, when the distal portion 23 of the tongue 19 resides in the base region 20, the distal portions 23 of the two parallel sections 19' of the tongue are compressed between and thereby frictionally engage portions 26 of the side wall that are adjacent the base region 20.

The compression of the tongue 19 also enables the tongue 19 to be disengaged from the groove 17 in another such building element 10 by frontally pulling the building element 10 from the other said building element 10. Such compression of the tongue 19 further enables the tongue 19 to be disengaged from the groove 18 in the other building element by twisting the building element 10 from the other building element 10. The tongue 19 can also be engaged with or disengaged from the groove 18 in the other such building element 10 by sliding the tongue 19 into or from one end of the groove 18 in the other building element 10.

Referring to FIG. 6, it is seen that adjacent the entry opening the groove 18 is defined by a first portion 31 of the side wall that is inclined outward at an entry angle a and a second portion 32 of the side wall that is inclined inward at a restrainign angle b that is less than the entry angle a in relation to a virtual broad surface 33 of the side wall so that less force is required to effect engagement by frontally pressing the tongue 19 into the groove 18 in the other such building element 10 than is required to effect disengagement by frontally pulling the building element 10 from the other building element 10.

The groove 18 is further defined by a third portion 34 of the side wall that is closer to an outside edge 35 of the groove 18 than the first portion 31 of the side wall and is inclined outward at a locating angle c that is less than the entry angle a in relation to the virtual broad surface 33 of the side wall in order to help position the distal portion 23 of the tongue 19 at the entry opening of the groove 18.

Still referring to FIG. 6, it is seen that a portion 37 of the tongue 19 that initially contacts the first portion 31 of the side wall when the tongue 19 is being frontally pressed into the groove 18 is inclined at approximately a complementary angle to the entry angle a.

Referring to FIGS. 4 and 5, it is seen that a portion 38 of the tongue 19 that is adjacent the second portion 32 of the at least one side wall when the distal portion 23 of the tongue 19 is engaged within the base region 20 of the groove 18 is inclined at an angle that is quite small in relation to the overall breadth (or virtual broad surface 33) of the side wall. This angle may be within a range between a complementary angle to the restraining angle b and zero degrees in relation to the overall breadth of the side wall.

At least one, and preferably both, of the parallel sections 19' of the split tongue 19 has a cross-sectional profile, as shown in FIGS. 4, 5 and 6, in which the distal portion 23 extends laterally to one edge of the uncompressed width W3 of the tongue 19, the indented intermediate portion 22 extends laterally approximately to one side of the entry opening of the groove 18 when the tongue 19 is engaged in the groove 18, as shown in FIGS. 4 and 5, and an outwardly extended further indented portion 41 is not as wide as the indented intermediate portion 22 in order to enhance the flexibility of the tongue section 10'. In alternative embodiments (not shown), (i) the side of the further indented portion 41 facing the other tongue section 19' is indented rather than the side of the further indented portion 41 that is shown as indented in FIGS. 4, 5 and 6; or (ii) neither side of the indented portion 41 is further indented but the respective lateral extensions of the indented portions 22, 41 and the distal portion 23 toward the other tongue section 19' are reduced in order to provide the requisite flexibility for the split tongue section 19'.

Preferably, the edges and the ends of the tongues 19 are rounded so as to soften their feel to the fingers of a child when one building element 10 is being interconnected with another such building element 10 by frontally pressing a tongue 19 of the one building element 10 into a groove 18 of the other building element 10.

Referring to FIG. 2, the side wall 13 has a primary surface 42 that includes recesses 43 adjacent the tongue sections 19' (as also shown in FIGS. 4, 5 and 6) so that the tongue sections 19' extend outward from below the primary surface 42 and thereby need not extend as far outward in relation to the primary surface 42 of the side wall 13 as otherwise would be required to attain the degree of flexibility provided by a given length of outward extension from the base of the tongue section 19'. An alternative embodiment (not shown) does not include such recesses adjacent the tongue sections.

The grooves 18, the tongues 19 and the recesses 43 extend vertically between the top 11 and the bottom of the building element 10. In one preferred embodiment, as shown in FIG. 7, the grooves 18, the tongues 19 and the recesses 43 extend vertically all the way to the top 11 and/or the bottom 12 of the building element 10, but the ends 47 of the tongues 19 do not extend outward in relation to the primary surface 42 of the side wall 13 as much as the predominant portion of the tongue 19 extends outward in relation to the primary surface 42 of the side wall 13 and the width of the ends 47 of the tongues 19 is not greater than the given predominant width W1 of the groove entry opening. This configuration facilitates initiation of interconnection of the building elements 10 when sliding the tongues 19 into the ends of the grooves 18. Initiation of interconnection of the building elements 10 effected by sliding the tongues 19 into the ends of the grooves 18 is also facilitated by the width of the ends 46 of the entry openings of the grooves 18 being greater than the given predominant width W1 of the groove entry opening.

In an alternative referred embodiment, as shown in FIG. 8, the grooves 18 and the recesses 43 extend all the way to the top 11 and/or the bottom 12 of the building element 10, but the tongues 19 do not, and thereby provide a step 44 adjacent the top 11 and/or the bottom 12 of the building element 10 that facilitates positioning the side wall 13 of one building element closer to the side wall 13 of another building element when initiating interconnection of the building elements 10 by sliding the tongues 19 into the ends of the grooves 18. Also, the width of the ends 49 of the tongues 19 is not greater than the given predominant width W1 of the groove entry opening, as also shown in FIG. 7. In other respects, the alternative preferred embodiment of FIG. 8 may include the same features as described above with reference to FIGS. 1 through 7.

In an alternative embodiment of the building element according to the present invention, as partially shown in FIG. 9, the grooves 18 are defined by portions 51 of the side wall that are flexible so that the entry openings of the grooves 18 can be expanded laterally in order to ease engagement when the tongues 19 are frontally pressed into the grooves 18. The side wall has a primary surface 42 that includes recesses 53 adjacent the portions 51 of the side wall that define the grooves 18 so that the flexible portions 51 extend below the primary surface 42 and thereby need not extend as far outward in relation to the primary surface 42 as otherwise would be required to attain the degree of flexibility provided by a given length of outward extension from the base of the flexible groove-defining portion 51 of the side wall. An alternative embodiment (not shown) does not include such recesses 53 adjacent the flexible groove-defining portion of the side wall. In other respects, the alternative preferred embodiment of FIG. 9 may include the same features as described above with reference to FIGS. 1 through 8.

Referring to FIGS. 10 through 12, another preferred embodiment of a building element 60 according to the present invention includes a top 61, a bottom 62 and eight side walls 63. The top 61 of the building element 60 includes a cylindrical projection 64 and the bottom 62 of the building element 60 is open.

The interior surfaces of the building element 60 include ribs 65 that are accessible through the open bottom 62 of the building element 60. The ribs 65 extend inwardly at a right angle from the center of four uniformly spaced interior side walls 66 for interconnecting with the projection 16 on the top of another such building element 60 in a releasable frictional engagement.

The eight side walls 63 define a unilateral octagon, in which each of a first set of every-second side walls includes a groove 68 but no tongue 69 and each of a second set of every-second side walls disposed between the side walls of the first set includes a tongue 69 but no groove 68. Accordingly, each side wall 63 is disposed at an oblique angle to the side walls 63 adjacent thereto.

The grooves 68 and the tongues 69 are dimensioned for enabling a tongue 69 on one building element 60 to reside in a groove 68 in another such building element 60 in a releasable restraining engagement in the same manner as described above with reference to the building element 10 of FIGS. 1–9.

Preferably the side walls 63, the projection 64, the interior ribs 65, the grooves 68 and the tongues 69 of the building element 60 of FIGS. 10–12 are also so dimensioned in relation to the dimension of the side walls 13, the projection 14, the interior ribs 15, the grooves 18 and the tongues 19 of the building element 10 of FIGS. 1–9, that the octagonal building elements 60 can be interconnected with the rectangular building elements 10, both side-to-side and top-to-bottom, to thereby provide a set of compatible building elements 10, 60. Each of the tongues 19 of the square building element 10 can be interconnected in a releasable restraining engagement within any of the grooves 68 of the octagonal building element 60; and each of the tongues 69 of the octagonal building element 60 can be interconnected in a releasable restraining engagement within any of the grooves 18 of the square building element 10.

Figure 13A:
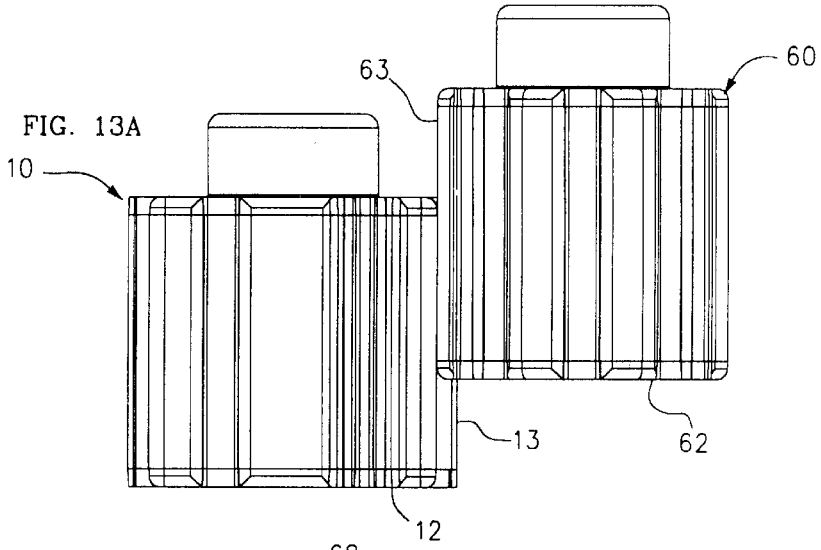
FIG. 13A is a side view of a set of building elements, wherein a building element according to FIG. 1 is interconnected to a building element of the type shown in FIG. 10.
Figure 13B:
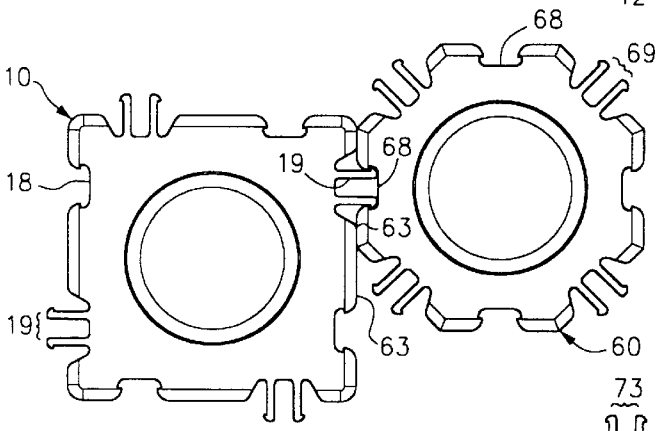
FIG. 13B is a top view of the set of building elements shown in FIG. 13A.

FIGS. 13A and 13B illustrate a building element 10 interconnected side-to-side with a building element 60, with a tongue 19 of the square building element 10 residing within in a groove 68 of the octagonal building element 60. FIG. 13A further illustrates a stationary relative disposition of the interconnected building elements 10, 60 that is enabled by the degree of frictional engagement provided by the compression of the tongue 19 when the distal portion 23 of the tongue 19 resides in the base region of the grooves 68, wherein the octagonal building element 60 has the top 61 of its engaged side wall 63 disposed at a greater height than the top 11 of the engaged side wall 13 of the square building element 10. As pointed out above with reference to FIGS. 1–9, the degree of frictional engagement provided by the comparison of the tongue 19 when the distal portion 23 of the tongue 19 resides in the base region of the groove 68 is also such as to enable the stationary relative disposition of the engaged building elements 10, 60 to be varied precisely by smoothly sliding the tongue 19 of one of the square building elements 10 within the groove 68 of the octagonal building elements 60.

Figure 14:
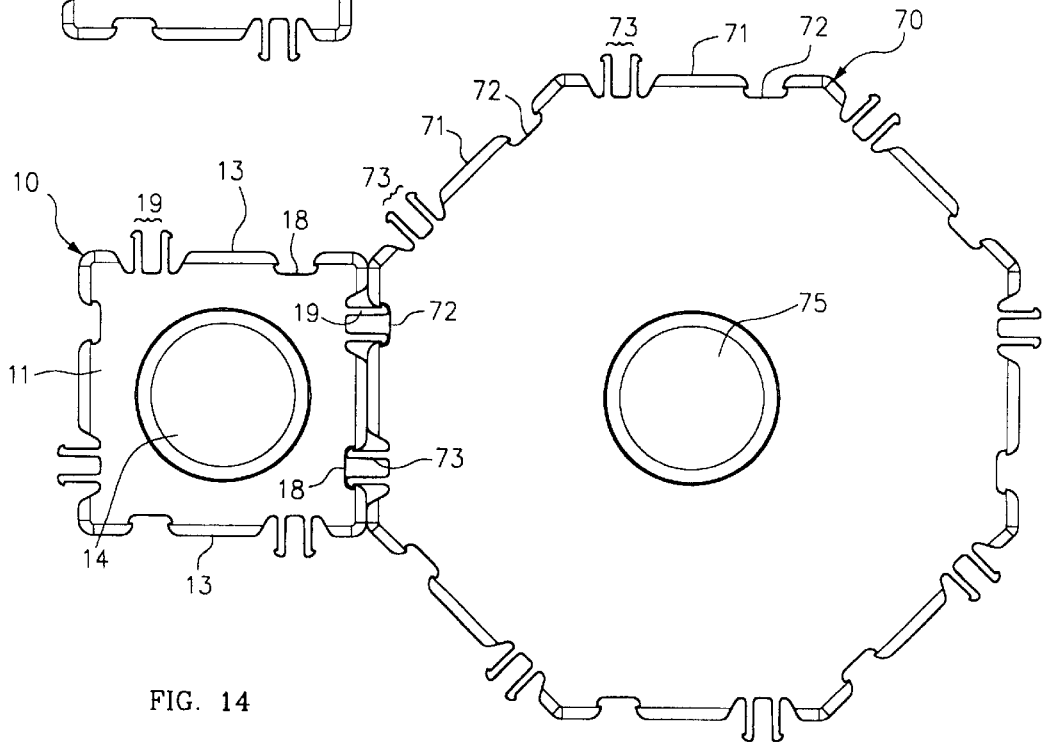
FIG. 14 is a top view of a building element according to FIG. 1 interconnected to another preferred embodiment of an octagonal building element according to the present invention.

Referring to FIG. 14, a larger embodiment of an octagonal building element 70 is combined in a set of building elements with a square building element 10 according to FIGS. 1–9. Each side wall 71 of the larger octagonal building element 70 is of the same length and includes one groove 72 and one tongue 73. The top 74 of the octagonal building element 70 includes a cylindrical projection 75. The bottom of the octagonal building element 70 is open. The interior of the octagonal building element 70 includes accessible ribs that are disposed for interconnecting with the projection 75 on the top of another such building element 70 in a releasable frictional engagement. In an alternative embodiment (not shown), the top 74 of the larger octagonal building element 70 includes a plurality of cylindrical projections and the interior of the larger octagonal building element 70 includes a network of accessible ribs that are disposed for interconnecting with the plurality of projections of the top of another such building element 70 in a releasable frictional engagement.

The grooves 72 and the tongues 73 are dimensioned for enabling a tongue 73 on one building element 70 to reside in a groove 72 in another such building element 70 in a releasable restraining engagement in the same manner as described above with reference to the building element 10 of FIGS. 1–9.

Preferably the side walls 71, the projection 75, the interior ribs, the grooves 72 and the tongues 73 of the larger octagonal building element 70 are also so dimensioned in relation to the dimensions of the side walls 13, the projections 14, the interior ribs 15, the grooves 18 and the tongues 19 of the building elements 10 of FIGS. 1–9, that the larger octagonal building elements 70 can be interconnected with the rectangular building elements 10, both side-to-side and top-to-bottom, to thereby provide a set of compatible building element 10, 70. Each of the tongues 19 of the square building element 10 can be interconnected in a releasable restraining engagement within any of the grooves 72 of the larger octagonal building element 70; and each of the tongues 73 of the larger octagonal building element 70 can be interconnected in a releasable restraining engagement within any of the grooves 18 of the square building element 10.

FIG. 14 illustrates a square building element 10 interconnected side-to-side with a larger octagonal building element 70, with a tongue 19 of the square building element 10 residing within a groove 72 of the octagonal building element 60, and with a tongue 73 of the larger octagonal building element 70 residing within in a groove 18 of the square building element 10.

Figure 15:
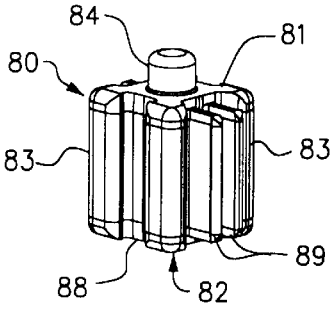
FIG. 15 is a top and two-sided perspective view of another preferred embodiment of a building element according to the present invention.
Figure 16:
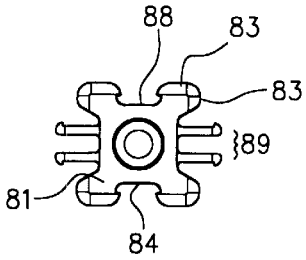
FIG. 16 is a top view of the building element of FIG. 15.
Figure 17:
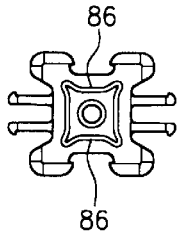
FIG. 17 is a bottom view of the building element of FIG. 15.

Referring to FIGS. 15 through 17, a preferred embodiment of a smaller building element 80 according to the present invention includes a top 81, a bottom 82 and four side walls 83. The top 81 of the building element 80 includes a cylindrical projection 84 and the bottom 82 of the building element 80 is open. The four side walls 83 define a square.

The interior side walls 86 of the smaller building element 80 are accessible through the open bottom 82 of the building element 80 and are disposed for interconnecting with the projection 84 on the top of another such smaller building element 80 in a releasable frictional engagement.

One opposite pair of the side walls 83 includes one groove 88 and no tongue, and the other opposite pair of side walls 83 includes a tongue 89 and no groove. The grooves 88 and tongues 89 are dimensioned for enabling a tongue 89 on one smaller building element 80 to reside in a groove 88 in another such smaller building element 80 in a releasable restraining engagement in the same manner as described above with reference to the building element 10 of FIGS. 1–9.

Figure 18:
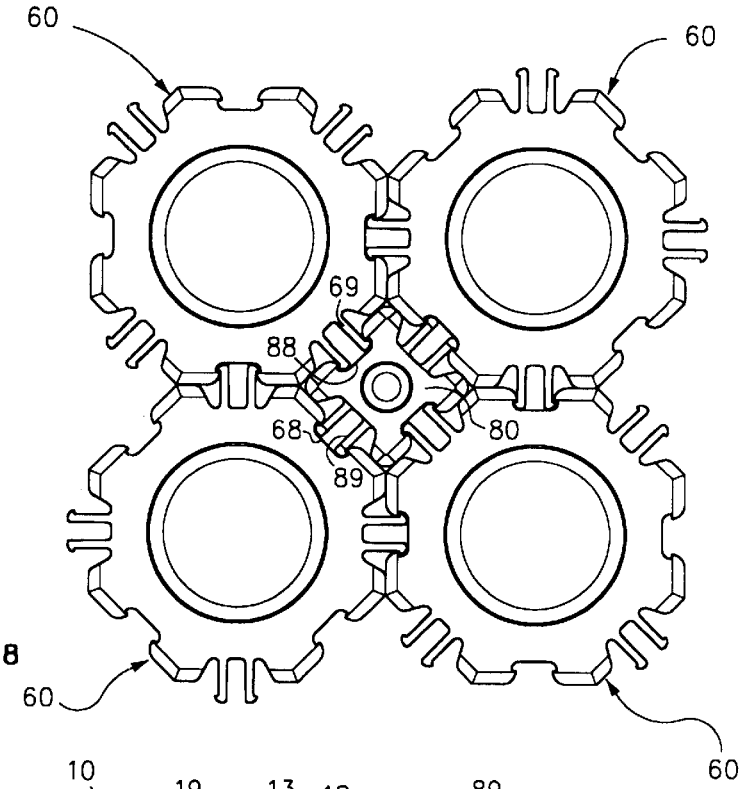
FIG. 18 is a top view of a set of building elements, wherein a plurality of building elements according to FIG. 10 are interconnected to one another and to a building element according to FIG. 15.

In one preferred embodiment of the smaller square building element 80, as shown in FIG. 18, the side walls 83, the grooves 88 and the tongues 89 of the smaller building element 80 are so dimensional in relation to the dimensions of the side walls 63, the grooves 68 and the tongues 69 of the building element 60 of FIGS. 10–12, that the octagonal building elements 60 can be interconnected side-to-side with the smaller rectangular building element 80, to thereby provide a set of compatible building elements 60, 80. Each of the tongues 89 of the smaller square building element 80 can be interconnected in a releasable restraining engagement within any of the grooves 68 of the octagonal building element 60; and each of the tongues 69 of the octagonal building element 60 can be interconnected in a releasable restraining engagement within any of the grooves 88 of the smaller square building element 80.

FIG. 18 illustrates a smaller square building element 80 interconnected side-to-side with four different octagonal building elements 60, with the tongues 89 of the smaller square building element 80 residing within grooves 68 of two different octagonal building elements 60, and with tongues 69 of two different octagonal building elements 60 residing within the grooves 88 of the smaller square building element 80. Note that the four octagonal building elements 60 are interconnected side-to-side with one another to form a closed loop and that the smaller square building element 80 is interconnected side-to-side with the four octagonal building elements 60 within the closed loop.

Figure 19:
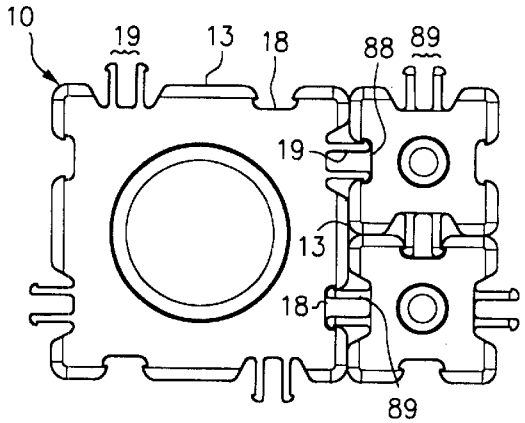
FIG. 19 is a top view of a set of building elements, wherein one side of a building element according to FIG. 1 is interconnected to a pair of interconnected building elements according to FIG. 15.

In another preferred embodiment of the smaller square building element 80, as shown in FIG. 19, the side walls 83, the grooves 88 and the tongues 89 of the smaller building element 80 are so dimensioned in relation to the dimensions of the side walls 13, the grooves 18 and the tongues 19 of the square building element 10 of FIGS. 1–9, that a pair of the smaller square building elements 80 can be interconnected side-to-side with each other and with the rectangular building element 10, to thereby provide a set of compatible building elements 10, 80. Each of the tongues 89 of the smaller square building element 80 can be interconnected in a releasable restraining engagement within any of the groove 18 of the square building elements 60; and each of the tongues 19 of the square building element 10 can be interconnected in a releasable restraining engagement within any of the grooves 88 of the smaller square building element 80.

FIG. 19 illustrates two smaller square building elements 80 interconnected side-to-side with each other and with one side of a larger square building elements 10, with a tongue 89 of one of the smaller square building elements 80 residing within a groove 18 of the larger square building element 10, with a tongue 19 of the larger square building element 10 residing within a groove 88 of the other of the two smaller square building elements 80, and with a tongue 89 of the other of the smaller square building elements 80 residing within a groove 88 of the one of the two smaller square building elements 80.

Figure 20:
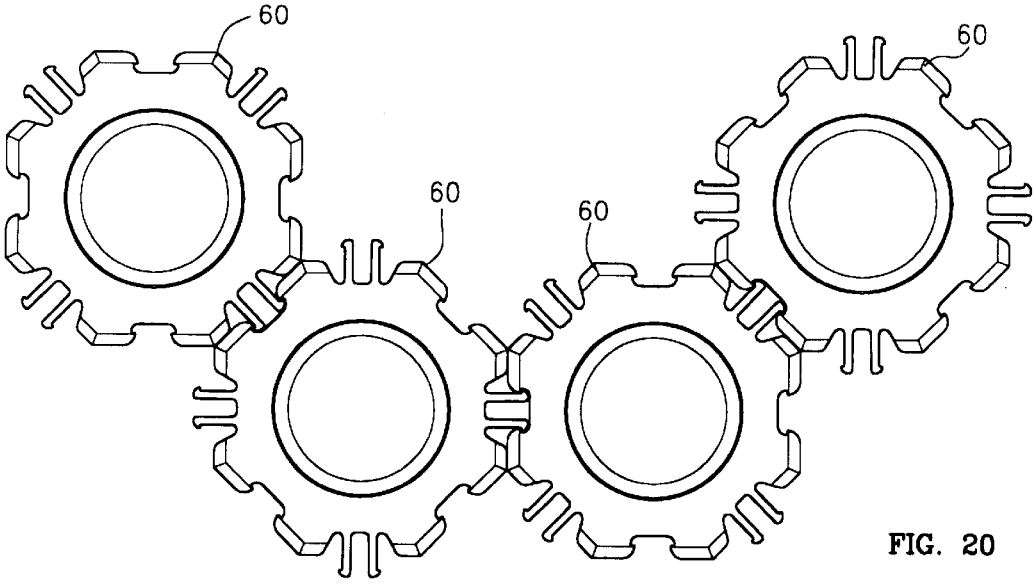
FIG. 20 is a top view of a set of interconnected building elements according to FIG. 10.

An oblique disposition of adjacent side walls, such as the side walls 63 of the ocatgonal building element 60, enables more varied structures to be configured when interconnecting the various building elements of the present invention. For example a rounded corner effect can be provided by the configuration of octagonal building elements 60 illustrated in FIG. 20.

Figure 21:
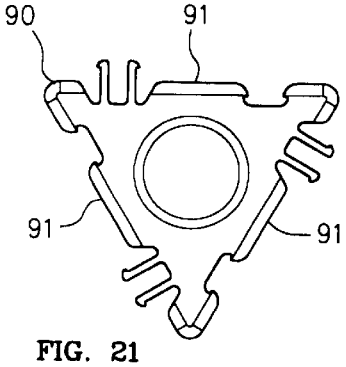
FIG. 21 is a top view of a further preferred embodiment of a building element according to the present invention, wherein the side walls define a triangle.
Figure 22:
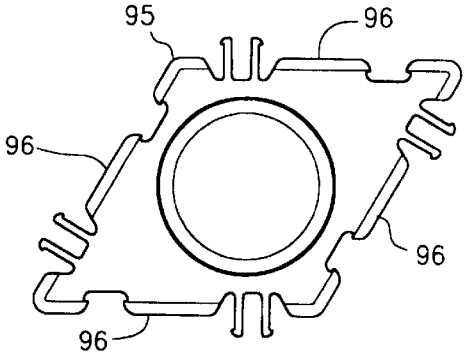
FIG. 22 is a top view of still a further preferred embodiment of a building element according to the present invention, wherein the side walls define a non-rectangular parallelogram.

There are an unlimited variety of building elements having an oblique disposition of adjacent side walls in accordance with the present invention. For example, FIG. 21 illustrates a building element 90 in which the side walls 91 define a triangle; and FIG. 22 illustrates a building element 95 in which the side walls 96 define a non-rectangular parallelogram. In other respects the triangular building element 90 and the non-rectangular-parallelogram building element 95 have the same features as the building element 10 described above with reference to FIGS. 1–9.

A set of toy building elements that are capable of being interconnected side-by-side in a releasable restraining engagement may include a first building element, such as a building element 60, in which one adjacent pair of side walls respectively including a groove and a tongue are disposed at a first oblique angle to one another; and a second building element such as a building element 90 or 95, in which one adjacent pair of side walls respectively including a groove and a tongue are disposed at a second oblique angle to one another, wherein the second oblique angle is different than the first oblique angle.

Figure 23:
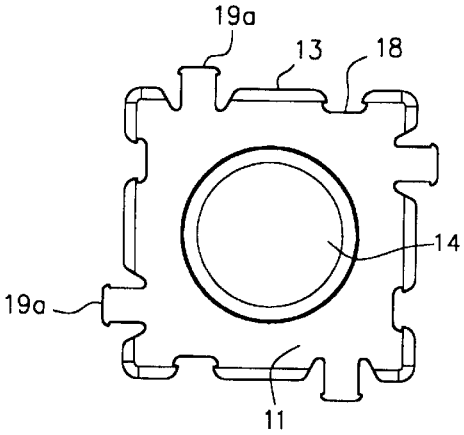
FIG. 23 is a top view illustrating a feature of the tongue in an alternative embodiment of the building element according to FIG. 1 that may be included in a set of building elements according to the present invention.
Figure 6:
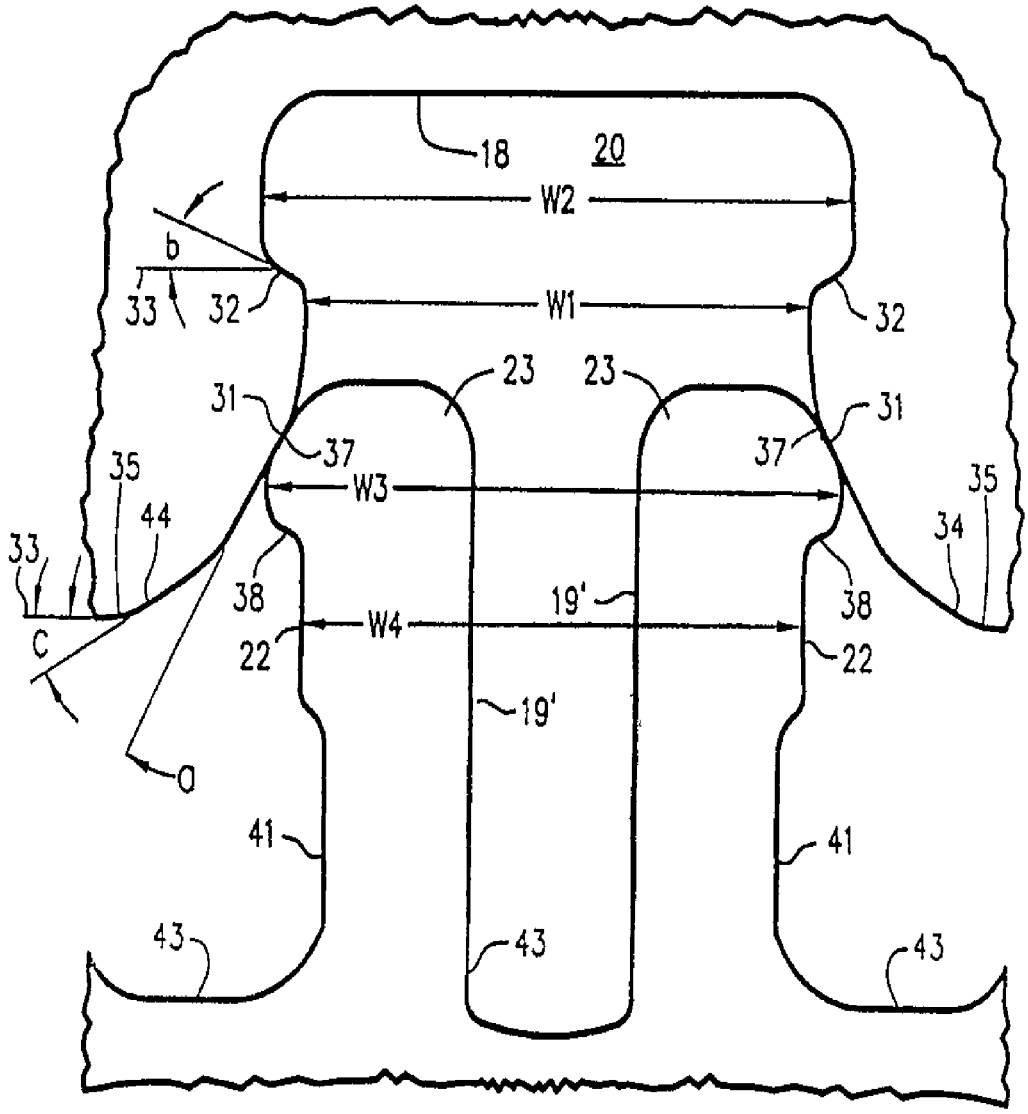

In alternative embodiments of the various building elements described above that are included in a set of building elements according to the present invention, the tongues are not split, but rather are solid, such as the tongue 91*a* in the square building element illustrated in FIG. 23. In some of these solid tongue embodiments, the material of the building element that defines the tongues and the grooves is flexible and/or the grooves are defined by portions of the side wall that are flexible, as described above with reference to FIG. 9, so that the entry openings of the grooves can be expanded laterally in order to ease engagement when the tongues are frontally pressed into the grooves. In other respects the solid-tongue building elements have the same features as the building element 10 described above with reference to FIGS. 1–8.

Referring to FIGS. 24 through 26, a preferred embodiment of a building element 100 according to the present invention includes a top 101, a bottom 102 and a plurality of side walls 103. The top 101 includes a two-dimensional array of cylindrical projections 104 and the bottom 102 is open. A network of ribs 106 is accessible through the open bottom 102 for interconnecting with one or more of the projections 104 on the top of another such building element 100 in a releasable frictional engagement. Although the building element 100 shown in the drawing has a relatively square lateral cross-section, the lateral cross-section of the building element 100 may be longer in one dimension than another, and may be other than rectangular, such as circular, semi- or quarter-circular or triangular, for example. Also, the top of the building element may include a different number and/or array of cylindrical projections 104 than shown in the drawing.

In another alternative embodiment (not shown), a building element of relatively the same size as shown in FIGS. 24 through 26 includes a single substantially larger cylindrical projection, as in the building element shown in FIGS. 1–9, and the interior surface include rids, as shown in FIG. 3, for interconnecting with the projection on the top of another such building element in a releasable frictional engagement. According to this alternative embodiment, a building element of twice the length of the building element shown in FIGS. 24 through 26 has two such larger cylindrical projections.

In one preferred embodiment, the side walls 103, the grooves 108 and the tongues 109 and/or the projection(s) 104 and the interior ribs 105, of the building element 100 of FIGS. 24–26 are so dimensional in relation to the dimensions of the side walls 13, the projection 14, the interior ribs 15, the grooves 18 and the tongues 19 of the building element 10 of FIGS. 1–9, that the octagonal building elements 60 can be interconnected with the rectangular building elements 10, both side-to-side and/or top-to-bottom, to thereby provide a set of compatible building elements 10, 100.

In the preferred embodiment shown in FIGS. 24 through 26, each side 103 of the building element 100 includes a plurality of grooves 108 and a plurality of tongues 109. In other respects the building element 100 has the same features as the building element 10 described above with reference to FIGS. 1–9.

In an alternative embodiment (not shown), the tongues of the building element of FIGS. 24–26 are solid, as discussed above with reference to FIG. 23.

Referring to FIG. 27, it is seen that the respective dispositions of the plurality of tongues 109 and the plurality of grooves 108 on and in the sides walls 103 of the building element 100 are such that one side wall 103 of one building element 100 can be interconnected to a side wall 103 of each of two other building elements 100 with at least two tongue-and-groove engagements between each pair of the interconnected building elements 100 to thereby enhance the interconnections between each pair of such interconnected building elements 100.

A set including a plurality of a given type of building element according to the present invention may include building elements having different side-wall width-to-height aspect ratios. For example, in a set of the type of building element shown in FIGS. 24–26, in which each side wall of each building element is of the same width, the side walls of some of the building elements have a height that is twice the height of the side walls of some of the other building elements.

In alternative embodiments (not shown), (a) the extension of the tongues and the grooves need not be vertical, and projections other than tongues can be pressed into sockets other than grooves to effect a releasable restraining engagement between the side walls of the building elements in accordance with the present invention; (b) coupling means other than described herein, such as those of the prior art, are included for interconnecting the top of one building element to the bottom of another building element in a releasable frictional engagement; (c) the side walls and/or tongues and grooves of one or more of the different types of building elements described herein are not so dimensioned as to enable side-to-side interconnection with one or more of the different types of building elements described herein; and/or (d) the top-to-bottom coupling means of one or more of the different types of building elements are not so configured and/or dimensioned as to enable top-to-bottom interconnection with a different type of building element.

The advantages specifically stated herein do not necessarily apply to every conceivable embodiment of the present invention. Further, such stated advantages of the present invention are only examples and should not be construed as the only advantages of the present invention.

While the above description contains many specificities, these should not be construed as limitations on the scope of the present invention, but rather as examples of the preferred embodiments described herein. Other variations are possible and the scope of the present invention should be determined not by the embodiments described herein but rather by the claims and their legal equivalents.

What is claimed is:

1. A building element for a set of toy building elements that are capable of being interconnected in a releasable engagement, comprising a top, a bottom and side walls;

wherein at least one of the side walls includes at least one groove having an entry opening of a given predominant width and a base region of a greater width;

wherein at least one of the side walls includes at least one tongue having an indented portion and a distal portion, with the distal portion having a predominant width that is greater than the width of the indented portion and greater than the given predominant width of the groove entry opening for interconnecting in a releasable restraining engagement with a said groove in a side wall of another said building element with the distal portion of the tongue residing in the base region of the groove; and wherein the tongue is flexible and split longitudinally into two parallel sections, each of which includes part of the indented portion and part of the distal portion of the tongue so that the distal portion of the tongue can be compressed laterally in order to effect said restraining engagement by frontally pressing the tongue into a said groove in another said building element;

wherein the uncompressed width of one of said portions of the tongue is greater than the predominant width of the portion of the groove that is adjacent said one portion of the tongue when the distal portion of the tongue resides in the base region of the groove so that said one portion of the tongue is then compressed between and thereby frictionally engages the portions of the side wall that define said adjacent portion of the groove.

2. A building element according to claim 1, wherein the degree of said frictional engagement provided by said compression of the tongue when the distal portion of the tongue resides in the base region of the groove is such as to enable a stationary relative disposition of a pair of so engaged building elements to be varied precisely by smoothly sliding the tongue of one of the pair of engaged building elements within the groove of the other of the pair of engaged building elements, and also is such as to provide enough resistance to said sliding as to maintain said stationary relative disposition when one of said pair of engaged building elements has the top of its engaged side wall disposed at a greater height than the top of the engaged side wall of the other of said pair of building elements.

3. A building element according to claim 1, wherein the uncompressed width of the indented portion of the tongue is greater than the predominant width of the groove entry opening so that, when the distal portion of the tongue resides in the base region of the said groove, the indented portions of the two parallel sections of the tongue are compressed between and thereby frictionally engages portions of the side wall that define the groove entry opening.

4. A building element according to claim 1, wherein the uncompressed width of the distal portion of the tongue is greater than the width of the base region of the said groove so that, when the distal portion of the tongue resides in the base region, the distal portions of the two parallel sections of the tongue are compressed between and thereby frictionally engage portions of the side wall that define the base region.

5. A building element for a set of toy building elements that are capable of being interconnected in a releasable engagement, comprising a top, a bottom and side walls;

wherein at least one of the side walls includes at least one groove having an entry opening of a given predominant width;

wherein at least one of the side walls includes at least one tongue having a distal portion, with the distal portion having a predominant width that is greater than the given predominant width of the groove entry opening for interconnecting in a releasable restraining engagement with a said groove in another said building element; and wherein a said side wall including the at least one tongue has a primary surface that includes recesses adjacent the tongue so that the tongue extends outward from below the primary surface.

6. A building element for a set of toy building elements that are capable of being interconnected in a releasable engagement, comprising a top, a bottom and side walls, wherein the top includes a first type of coupling means and the bottom includes a second type of coupling means for interconnecting with the first type of coupling means on another said buildings element in a releasable frictional engagement;

wherein at least one of the side walls includes at least one groove having an entry opening of a given predominant width;

wherein at least one of the side walls includes at least one tongue having a distal portion, with the distal portion having a predominant width that is greater than the given predominant width of the groove entry opening for interconnecting in a releasable restraining engagement with a said groove in another said building element;

wherein the tongue is flexible and split longitudinally so that the tongue can be compressed laterally in order to effect said restraining engagement by frontally pressing the tongue into a said groove in another said building element; and wherein at least one of an adjacent pair of side walls are disposed at an oblique angle to one another, with each of said obliquely disposed adjacent pair including at least one said groove and at least one said tongue.

7. A building element for a set of toy building elements that are capable of being interconnected in a releasable engagement, comprising a top, a bottom and side walls, wherein the top includes a first type of coupling means and the bottom includes a second type of coupling means for interconnecting with the first type of coupling means on another said building element in a releasable frictional engagement;

wherein at least one of the side walls includes at least one groove having an entry opening of a given predominant width;

wherein at least one of the side walls includes at least one tongue having a distal portion, with the distal portion having a predominant width that is greater than the given predominant width of the groove entry opening for interconnecting in a releasable restraining engagement with a said groove in another said building element;

wherein the tongue is flexible and split longitudinally so that the tongue can be compressed laterally in order to effect said restraining engagement by frontally pressing the tongue into a said groove in another said building element; and wherein each of a plurality of the side walls includes a plurality of said grooves and a plurality of said tongues.

8. A building element for a set of toy building elements that are capable of being interconnected in a releasable engagement, comprising a top, a bottom and side walls;

wherein at least one of the side walls includes at least one groove having an entry opening of a given predominant width and a base region of a greater width;

wherein at least one of the side walls includes at least one tongue having a distal portion, with the distal portion having a predominant width that is greater than the given predominant width of the groove entry opening for interconnecting in a releasable restraining engagement with a said groove in another said building element;

wherein the at least one tongue and/or the entry opening of the at least one groove is flexible so that said restraining engagement can be effected by frontally pressing the tongue into a said groove in another building element; and wherein one of an adjacent pair of side walls includes at least one said groove and the other of the adjacent pair includes at least one said tongue, and the adjacent pair are disposed at an oblique angle to one another;

characterised in that (a) each of said obliquely disposed adjacent pair of side walls includes at least one said groove and at least one said tongue; or (b) the side walls define an octagon, each of a first set of every-second side wall includes a said groove but no tongue, and each of a second set of every-second side walls disposed between the side walls of the first set includes a said tongue but no groove; or (c) the side walls define an octagon, and each side wall includes at least one said groove and at least one said tongue; or (d) the side walls define a four-sided parallelogram having four oblique angles, with at least one of the side walls including at least one said groove and with at least one of the side walls including at least one said tongue.

9. A building element according to claim 8, wherein each of said obliquely disposed adjacent pair of side walls includes at least one said groove and at least one said tongue.

10. A building element according to claim 8, wherein the side walls define an octagon, each of a first set of every-second side walls includes a said groove but no tongue and each of a second set of every-second side walls disposed between the side walls of the first set includes a said tongue but no groove.

11. A set of toy building elements that are capable of being interconnected side-by-side in a releasable restraining engagement, comprising at least four first building elements according to claim 10; and at least one second building element, comprising a top, a bottom and side walls defining a rectangle;

wherein each of two oppositely disposed side walls of the second building element includes one groove having an entry opening of the given predominant width and a base region of a greater width;

wherein each of the other two oppositely side walls of the second building element includes at least on tongue having a distal portion, with the distal portion having a predominant width that is greater than the given predominant width of the groove entry opening of the first and second building elements for interconnecting in a releasable restraining engagement with a said groove in either the first building element or another said second building element; and wherein each second building element is dimensioned for disposition within an enclosed space between four of the first building element that are interconnected to define said enclosed space.

12. A building element according to claim 8, wherein the side walls define an octagon, and each side wall includes at least one said groove and at least one said tongue.

13. A set of toy building elements that are capable of being interconnected side-by-side in a releasable restraining engagement, comprising a first building element according to claim 10; and a second building element, comprising a top, a bottom and side walls defining a rectangle;

wherein at least one of the side walls of the second building element includes at least one groove having an entry opening of the given predominant width and a base region of a greater width;

wherein at least one of the side walls of the second building element includes at least one tongue having a distal portion, with the distal portion having a predominant width that is greater than the given predominant width of the groove entry opening of the first and second building elements for interconnecting in a releasable restraining engagement with a said groove in either the first building element or another said second building element; and wherein one of an adjacent pair of the side walls of the second building element includes at least one said groove and the other of the adjacent pair includes at least one said tongue.

14. A set of toy building elements that are capable of being interconnected side-by-side in a releasable restraining engagement, comprising a first building element according to claim 10; and a second building element, comprising a top, a bottom and side walls defining a rectangle;

wherein at least one of the side walls of the second building element includes at least one groove having an entry opening of the given predominant width and a base region of a greater width;

wherein at least one of the side walls of the second building element includes at least one tongue having a distal portion, with the distal portion having a predominant width that is greater than the given predominant width of the groove entry opening of the first and second building elements for interconnecting in a releasable restraining engagement with a said groove in either the first building element or another said second building element; and wherein each of the side walls of the second building element includes at least one said groove or at least one said tongue.

15. A set of toy building elements that are capable of being interconnected side-by-side in a releasable restraining engagement, comprising a first building element according to claim 10; and a second building element, comprising a top, a bottom and side walls defining a rectangle;

wherein at least one of the side walls of the second building element includes at least one groove having an entry opening of the given predominant width and a base region of a greater width;

wherein at least one of the side walls of the second building element includes at least one tongue having a distal portion, with the distal portion having a predominant width that is greater than the given predominant width of the groove entry opening of the first and second building elements for interconnecting in a releasable restraining engagement with a said groove in either the first building element or another said second building element; and wherein each of the side walls of the second building element includes at least one said groove and at least one said tongue.

16. A building element according to claim 8, wherein the side walls define a four-sided parallelogram having four oblique angles, with at least one of the side walls including at least one said groove and with at least one of the side walls including at least one said tongue.

17. A set of toy building elements that are capable of being interconnected side-by-side in a releasable restraining engagement, comprising a first building element according to claim 8; and a second building element, comprising a top, a bottom and side walls defining a rectangle;

wherein at least one of the side walls of the second building element includes at least one groove having an entry opening of the given predominant width and a base region of a greater width;

wherein at least one of the side walls of the second building element includes at least one tongue having a distal portion, with the distal portion having a predominant width that is greater than the given predominant width of the groove entry opening of the first and second building elements for interconnecting in a releasable restraining engagement with a said groove in either the first building element or another said second building element; and wherein one of an adjacent pair of the side walls of the second building element includes at least one said groove and the other of the adjacent pair includes at least one said tongue.

18. A set of toy building elements that are capable of being interconnected side-by-side in a releasable restraining engagement, wherein a first building element and a second building element each comprises a top, a bottom and side walls;

wherein at least one of the side walls includes at least one groove having an entry opening of a given predominant width and a base region of a greater width;

wherein at least one of the side walls includes at least one tongue having a distal portion, with the distal portion having a predominant width that is greater than the given predominant width of the groove entry opening for interconnecting in a releasable restraining engagement with a said groove in another said building element;

wherein the at least one tongue and/or the entry opening of the at least one groove is flexible so that said restraining engagement can be effected by frontally pressing the tongue into a said groove in another said building element;

wherein one of an adjacent pair of the side walls includes at least one said groove and the other of the adjacent pair includes at least one said tongue, and the adjacent pair are disposed at an oblique angle to one another;

wherein in the first building element a said one adjacent pair of side walls are disposed at a first oblique angle to one another; and wherein in the second building element a said one adjacent pair of side walls are disposed at a second oblique angle to one another, with the second oblique angle being different than the first oblique angle.

19. A set of toy building elements that are capable of being interconnected side-by-side in a releasable restraining engagement, comprising a first building element according to claim 12; and a second building element, comprising a top, a bottom and side walls defining a rectangle;

wherein at least one of the side walls of the second building element includes at least one groove having an entry opening of the given predominant width and a base region of a greater width;

wherein at least one of the side walls of the second building element includes at least one tongue having a distal portion, with the distal portion having a predominant width that is greater than the given predominant width of the groove entry opening of the first and second building elements for interconnecting in a releasable restraining engagement with a said groove in either the first building element or another said second building element; and wherein one of an adjacent pair of the side walls of the second building element includes at least one said groove and the other of the adjacent pair includes at least one said tongue.

20. A set of toy building elements that are capable of being interconnected side-by-side in a releasable restraining engagement, comprising a first building element according to claim 12; and a second building element, comprising a top, a bottom and side walls defining a rectangle;

wherein at least one of the side walls of the second building element includes at least one groove having an entry opening of the given predominant width and a base region of a greater width;

wherein at least one of the side walls of the second building element includes at least one tongue having a distal portion, with the distal portion having a predominant width that is greater than the given predominant width of the groove entry opening of the first and second building elements for interconnecting in a releasable restraining engagement with a said groove in either the first building element or another said second building element; and wherein each of the side walls of the second building element includes at least one said groove or at least one said tongue.

21. A set of toy building elements that are capable of being interconnected side-by-side in a releasable restraining engagement, comprising a first building element according to claim 12; and a second building element, comprising a top, a bottom and side walls defining a rectangle;

wherein at least one of the side walls of the second building element includes at least one groove having an entry opening of the given predominant width and a base region of a greater width;

wherein at least one of the side walls of the second building element includes at least one groove having a entry opening of the given predominant width and a base region of a greater width;

wherein at least one of the side walls of the second building element includes at least one tongue having a distal portion, with the distal portion having a predominant width that is greater than the given predominant width of the groove entry opening of the first and second building elements for interconnecting in a releasable restraining engagement with a said groove in either the first building element or another said second building element; and wherein one of the side walls of the second building element includes at least one said groove and at least one said tongue.

* * * * *

UNITED STATES PATENT AND TRADEMARK OFFICE

CERTIFICATE OF CORRECTION

PATENT NO. : 6,616,499 B1
DATED : September 9, 2003
INVENTOR(S) : Soren Christian Sorensen It is certified that error appears in the above-identified patent and that said Letters Patent is hereby corrected as shown below:

Column 9,
Line 10, “10” should be -- 19 --

Column 13,
Line 1, “groove”should be -- grooves --

Column 14,
Line 15, “surface” should be -- surfaces --
Line 15, “rids” should be -- ribs --
Line 25, “dimensional” should be -- dimensional --

Column 18,
Line 19, “on” should be -- one --

Column 22,
Lines 1-4, should be deleted
Line 14, “one” should be -- each --

Signed and Sealed this

Twenty-first Day of June, 2005

JON W. DUDAS
*Director of the United States Patent and Trademark Office*

UNITED STATES PATENT AND TRADEMARK OFFICE

CERTIFICATE OF CORRECTION

PATENT NO. : 6,616,499 B1
APPLICATION NO. : 09/889621
DATED : September 9, 2003
INVENTOR(S) : Soren Christian Sorensen It is certified that error appears in the above-identified patent and that said Letters Patent is hereby corrected as shown below:

The sheet of drawing consisting of figure 6 should be deleted to appear as per attached figure 6.

Signed and Sealed this

Twenty-seventh Day of March, 2007

JON W. DUDAS
*Director of the United States Patent and Trademark Office*